United States Patent [19]

Reaves et al.

[11] Patent Number: 4,741,128

[45] Date of Patent: May 3, 1988

[54] CUTTER ASSEMBLY

[75] Inventors: Benjamin H. Reaves, West Texas City; William E. Nelson, Dickinson, both of Tex.

[73] Assignee: Amoco Corporation, Chicago, Ill.

[21] Appl. No.: 896,757

[22] Filed: Aug. 14, 1986

[51] Int. Cl.[4] ..... B24B 19/00

[52] U.S. Cl. ..... 51/241 S; 51/245; 51/272; 29/156.8 R

[58] Field of Search ..... 51/272, 241 S, 241 B, 51/245; 29/156.8 R

[56] References Cited

U.S. PATENT DOCUMENTS

| | | | |
|---|---|---|---|
| 2,188,720 | 1/1940 | McQuade | 51/241 B |
| 2,238,785 | 4/1941 | Walton | 51/245 |
| 2,458,472 | 1/1949 | Irwin | 51/245 |
| 2,756,552 | 7/1956 | Gordon | 51/241 B |
| 2,835,084 | 5/1958 | Fotre | 51/272 |
| 2,846,828 | 8/1958 | Pilon | 51/241 B |
| 3,606,707 | 9/1977 | Naslund | 51/241 S |
| 4,086,732 | 5/1978 | Ramsey | 51/241 S |
| 4,109,635 | 8/1978 | Rossborough | 51/241 S |

*Primary Examiner*—Harold D. Whitehead

*Attorney, Agent, or Firm*—Thomas W. Tolpin; William H. Magidson; Ralph C. Medhurst

[57] ABSTRACT

The stator blades (vanes) of a gas turbine are removed and restored in considerably less time with an easy-to-use, special cutter assembly which arcuately cuts the encased portions of the stator blades in an efficient and effective manner. The cutter assembly has special, adjustable control arms with a power-driven grinding wheel and a saddle assembly which serves as a guide template to facilitate setup and cutting of the stator blades.

5 Claims, 8 Drawing Sheets

CUTTER ASSEMBLY

BACKGROUND OF THE INVENTION

This invention pertains to repairing the blades (vanes) of a gas turbine and, more particularly, to a cutter assembly and process for removing and restoring the blades or vanes of a gas turbine.

Gas turbines are extensively used in oil refineries, such as with catalytic cracking units, ultracracking units, power houses, and cogeneration plants, as well as in chemical plants, power plants, and other industrial sites to generate power.

In gas turbines, the moving rotor blades and the stationary stator blades experience considerable wear over time due to erosion from dust, metal chips, and other solid particulates and chemical corrosion from corrosive gases, such as sulfur oxides and nitrogen oxides, in the surrounding environment. Gas turbines with worn blades are inefficient and often ineffective and must be periodically repaired.

The repair and restoration of gas turbine blades (vanes) is not an easy job. It usually requires a team of at least four or five people working 7 to 10, 24-hour, days to fix and restore the gas turbine blades. During such repair, the associated refinery equipment and operating unit are often required to be shut down, thereby causing loss of revenue ranging from about 1.75 to 10 million dollars. Not only is such repair expensive from a standpoint of loss of revenue, but it is tedious, cumbersome, time-consuming, and difficult.

Over the years a variety of methods have been suggested for overhauling, repairing, and replacing worn stator blades of a gas turbine. Such prior art methods include heating, hammering, acetylene torching, chemical dissolution, plasma deposition, machining, and punching. In one common prior art method, the stator blades are heated to a temperature of 600° F. to 800° F. and the blades, base ring sections (shrouds), and/or the compressor case of the gas turbine are hammered. Heating to such high temperatures followed by hammering can cause considerable damage to the compressor case, thereby requiring replacement, further downtime, and considerable expense.

Typifying, some of the different prior art methods, techniques, and equipment for repairing turbine blades, as well as other machines and machining operations, are those shown in U.S. Pat. Nos. 1,795,262; 1,798,224; 3,099,902; 3,421,265; 3,641,709; 4,141,124; 4,291,448; 4,291,973; 4,376,356; and 4,464,865. The above prior art methods, techniques, and equipment have met with varying degrees of success.

It is, therefore, desirable to provide an improved cutter assembly and process for revamping gas turbine blades.

SUMMARY OF THE INVENTION

An improved cutter assembly are provided to revamp, overhaul, repair, and restore turbine blades (vanes) and especially the stationary stator blades of an axial compressor case of a gas turbine. Advantageously, the novel cutter assembly and process are efficient, easy to use, and effective. They are also safe, simple, economical, and save considerable time and manpower.

To this end, the novel cutter assembly has a power-driven grinding wheel, one or more counterweights, at least one and preferably two control arms (swing arms) which extend between and connect the grinding wheel and counterweight, and a steering wheel assembly or other rotation equipment to arcuately move and rotate the swing arms and grinding wheel about the stator blades of a gas turbine. In the preferred form, an adjustment assembly is provided to adjust the length (diameter) of the arms and the depth of cut of the grinding wheel. Preferably, the cutter assembly is equipped with a safety shield, a reduction gear unit (gear box), and a special straddle assembly to support the reduction gear unit and associated equipment as well as to facilitate setup and cutting of the encased portions (dovetail stubs) of the turbine blades.

In order to revamp, overhaul, and restore the stator blades of a gas turbine, the encased dovetail stub portions of the stator blades and the base ring section (shroud) of the compressor to which the stator blades are attached, are arcuately cut in two or more pieces with the grinding wheel of the cutter assembly. The cut stub portions of the stator blade and base ring section can be optionally heated such as with an oxy-acetylene torch, and are knocked out of the compressor case with a hammer. After the worn stator blades have been removed, new blades are inserted into the grooved channels (tails) of the compressor case, preferably at uniform intervals, and the gas turbine is reassembled.

A more detailed explanation of the invention is provided in the following description and appended claims taken in conjunction with the accompanying drawings.

BRIEF DESCRIPTION OF THE DRAWINGS

FIG. 6 is a top view of a portion of the cutter assembly;

DETAILED DESCRIPTION OF THE PREFERRED EMBODIMENT

Figure 1:
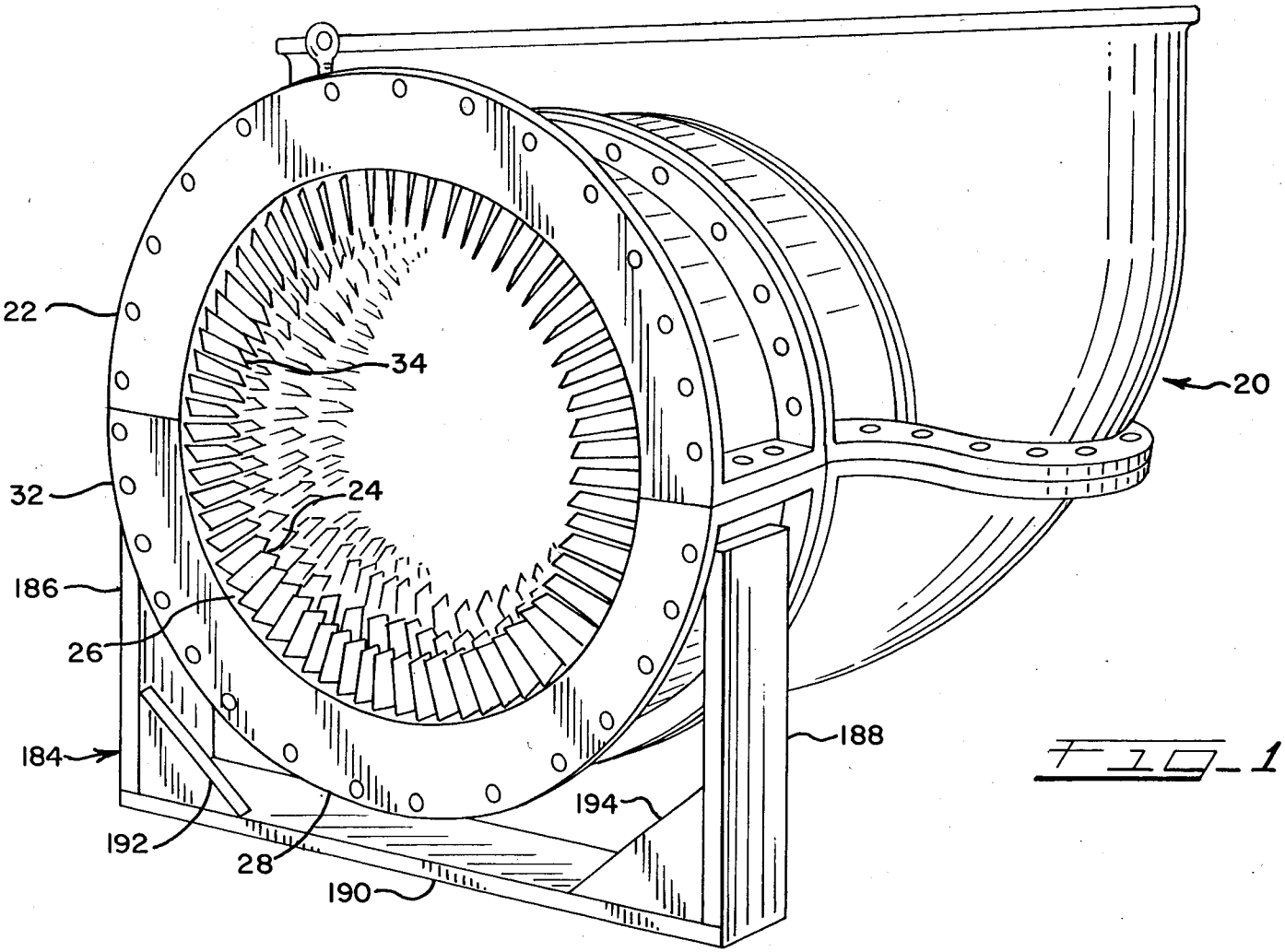
FIG. 1 is a perspective view of an axial flow compressor case of a gas turbine.

As shown in FIG. 1, a typical gas turbine 20, such as a frame 5, 6, or 7 gas turbine, has an axial flow compressor 22 which is connected along a common shaft to a power recovery section. The gas turbine can have as many as 16 stages or more to stage the pressure within the gas turbine, such as from atmospheric pressure to 990 psi. Gas turbines are used for generating power in oil refineries, such as for catalytic cracking units, ultra cracking units, or cogeneration plants, as well as in petrochemical plants, power plants, and other industrial sites.

The gas turbine has stationary stator blades or vanes 24 and rotating rotor blades or vanes. The stator and rotor blades wear out from use and prolonged exposure to particulates and corrosive gases and have to be periodically repaired, replaced, or restored. In order to repair the blades, the axial flow compressor and the rotor assembly is removed from the gas turbine and disassembled. The stator blades of the axial flow compressor are mounted and encased in the base ring sections, shrouds, root sections, or holders 26 of the axial flow compressor case 28. The base ring sections are typically mounted in undercut dovetail sections or grooved channels 30 (FIG. 2) of the axial flow compressor case. The base ring sections and axial flow compressor case are typically split into quadrants or semicircular portions 32.

Figure 2:
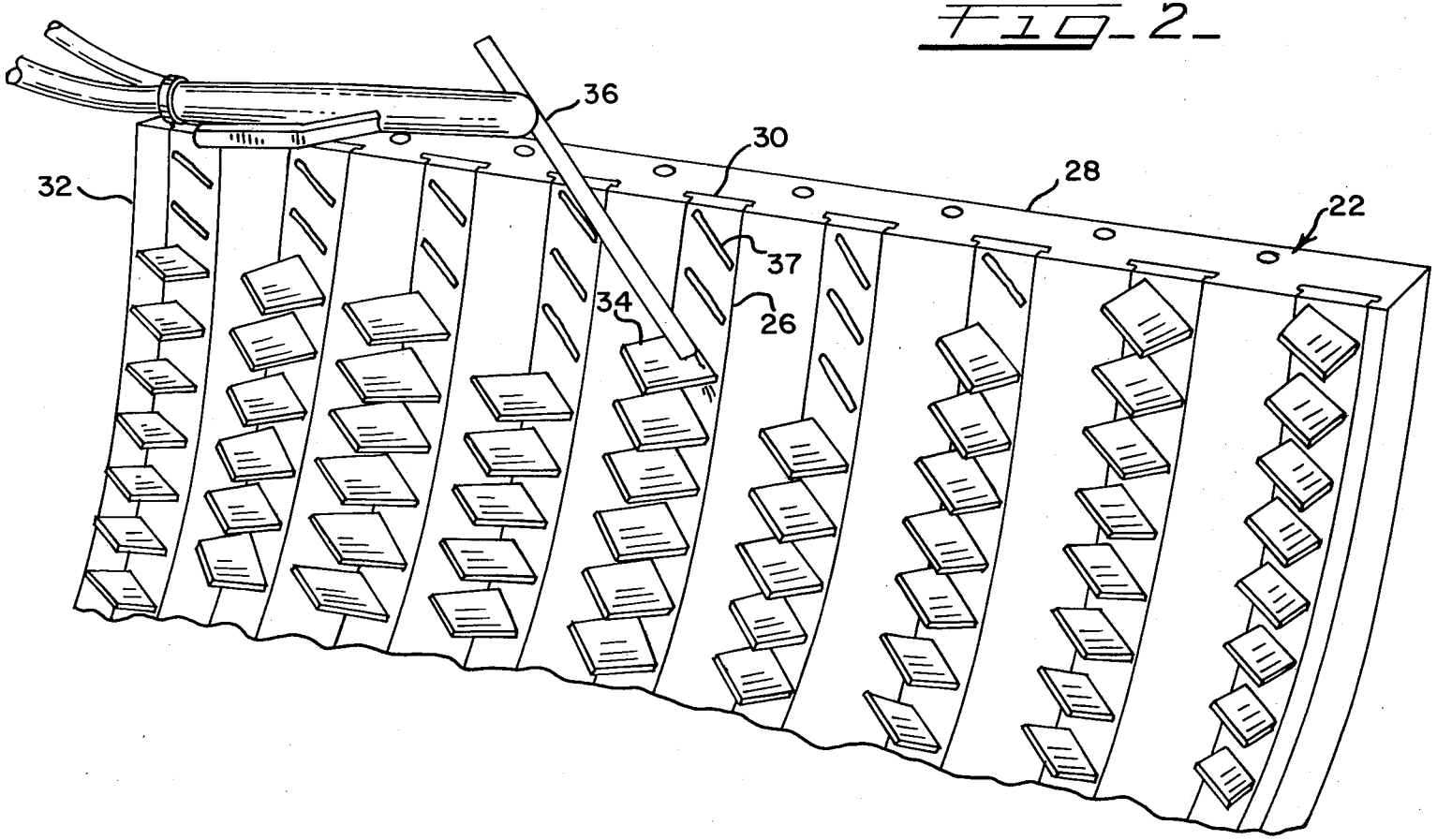
FIG. 2 illustrates the upper portions of the stator blade being removed by an arc air torch.
Figure 7:
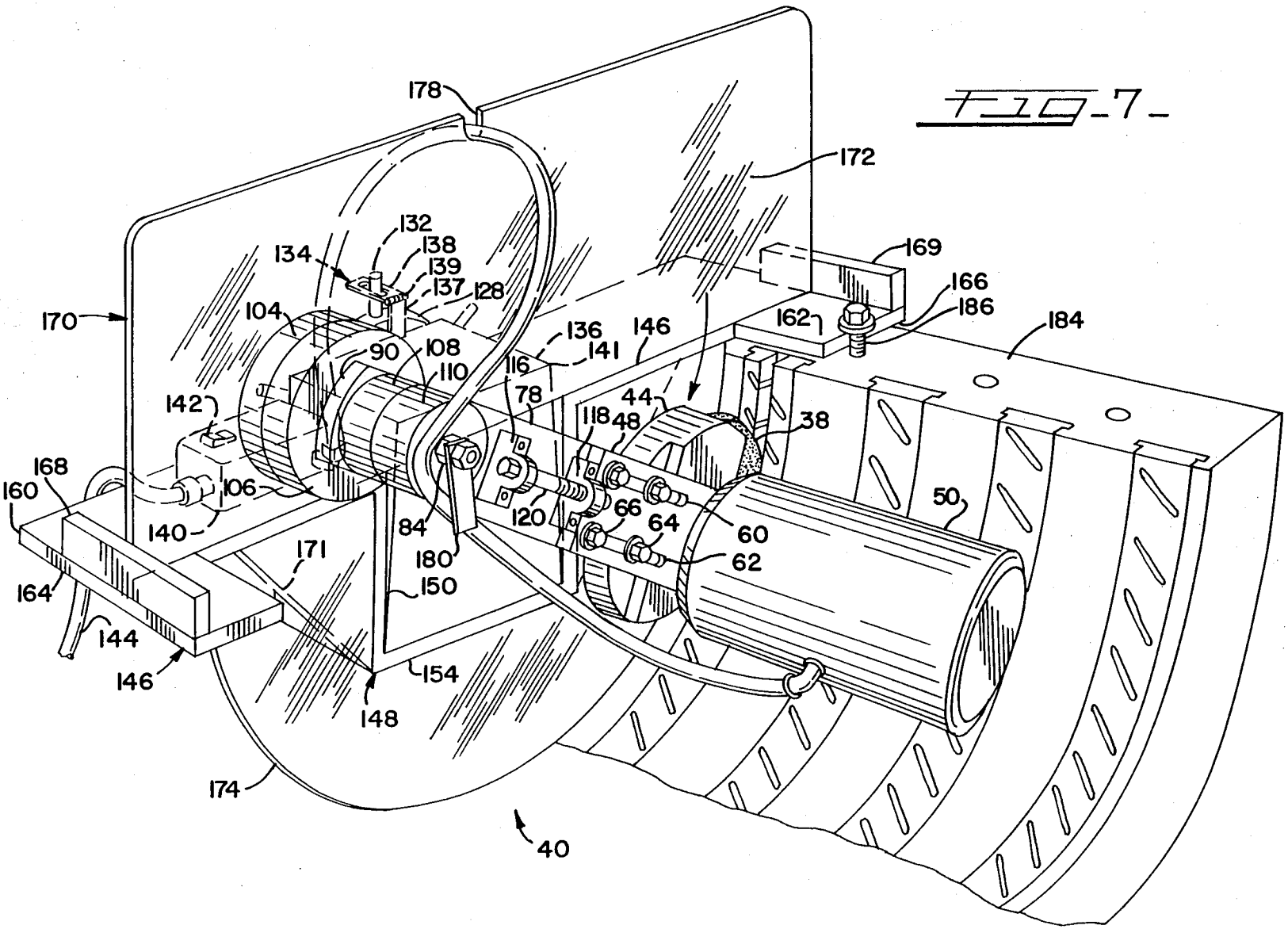
FIG. 7 is a perspective view of the cutter assembly acruately cutting the lower encased stub portions of the stator blades.

In order to remove the stator blades of the axial flow compressor case, the upper elongated portions 34 of the stator blades, which extend radially inwardly of the base ring section, are removed, severed, and cut by a torch, such as an arc air torch 36, as shown in FIG. 2. Thereafter, the lower stub portions 37, which are encased in a tight interference fit in the base ring sections, are arcuately cut in half by the rotating abrasive grinding wheel 38 of a stator blade cutter assembly 40, as shown in FIG. 7. The grinding wheel has to have sufficient structural and abrasive strength to cut the carbon steel base ring sections (root sections or holders) of the steel blades (vanes).

Figure 8:
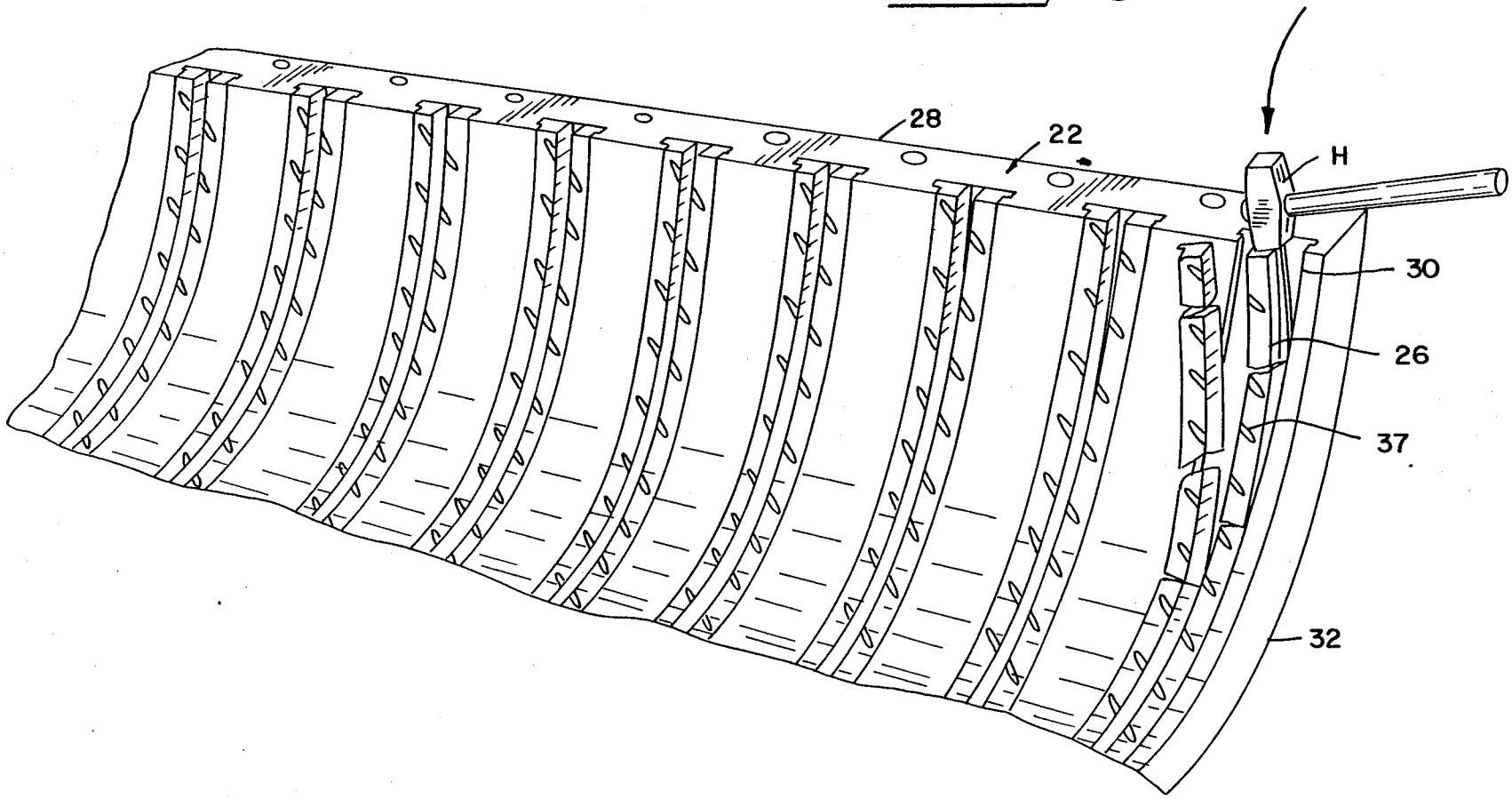
FIG. 8 is a perspective view of the cut lower stub portions of the stator blades being jarred loose and knocked out by a hammer.
Figure 9:
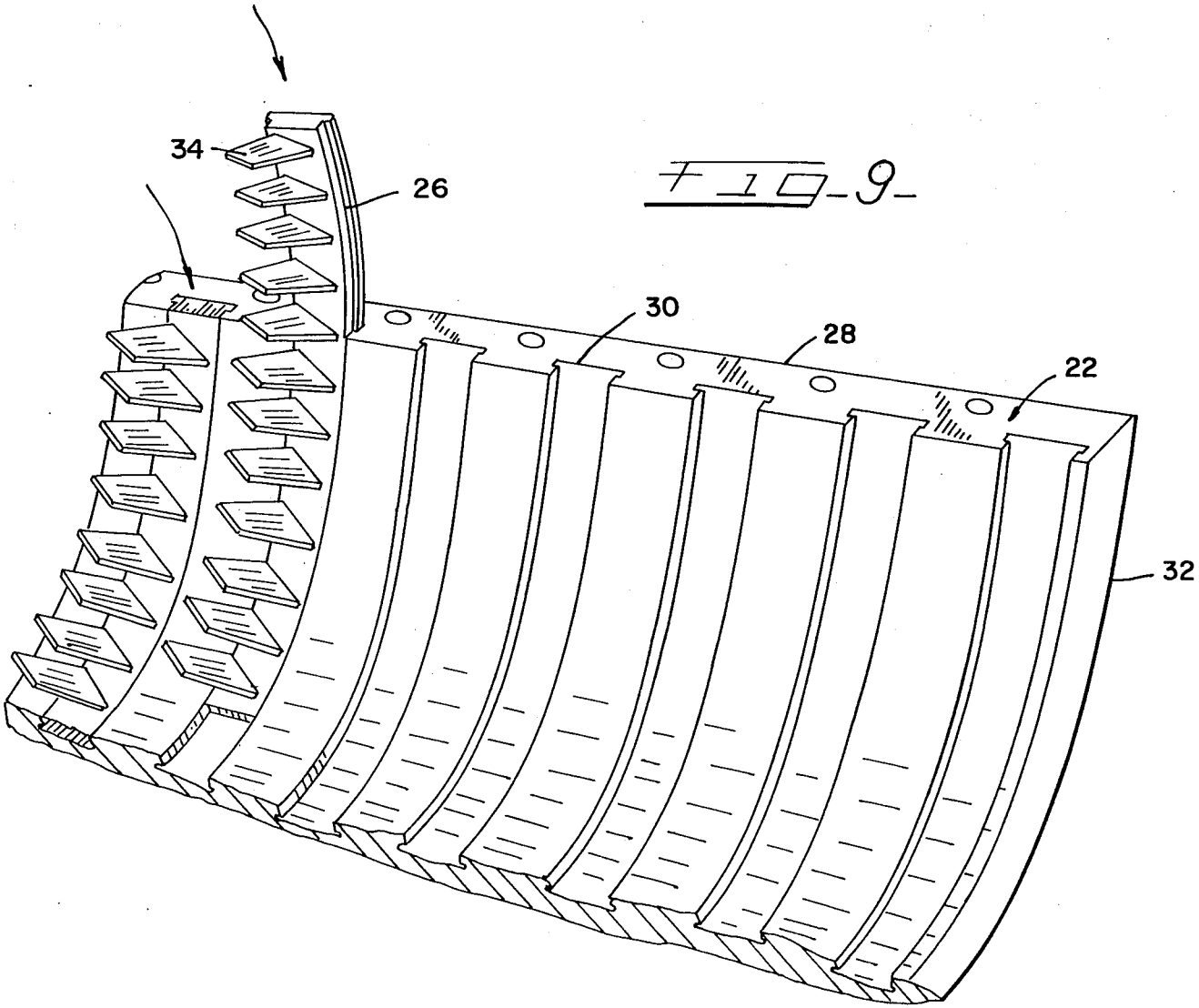

The cut stub portions of the stator blades and root sections can then be heated to a temperature less than 425° F. before being repetitively struck and loosened with the hammer. The cut stub portions and root sections are repetitively struck with a hammer as shown in FIG. 8, to jar loose, vibrate, and knock-out the remaining portions of the stator blades and base ring sections from the compressor case. If desired, the cast iron, axial flow compressor case can also be repetitively struck with a hammer H to facilitate removal of the root sections and the cut stator blades, but care must be taken not to use excessive force which might crack or otherwise damage the compressor case.

Figure 9:
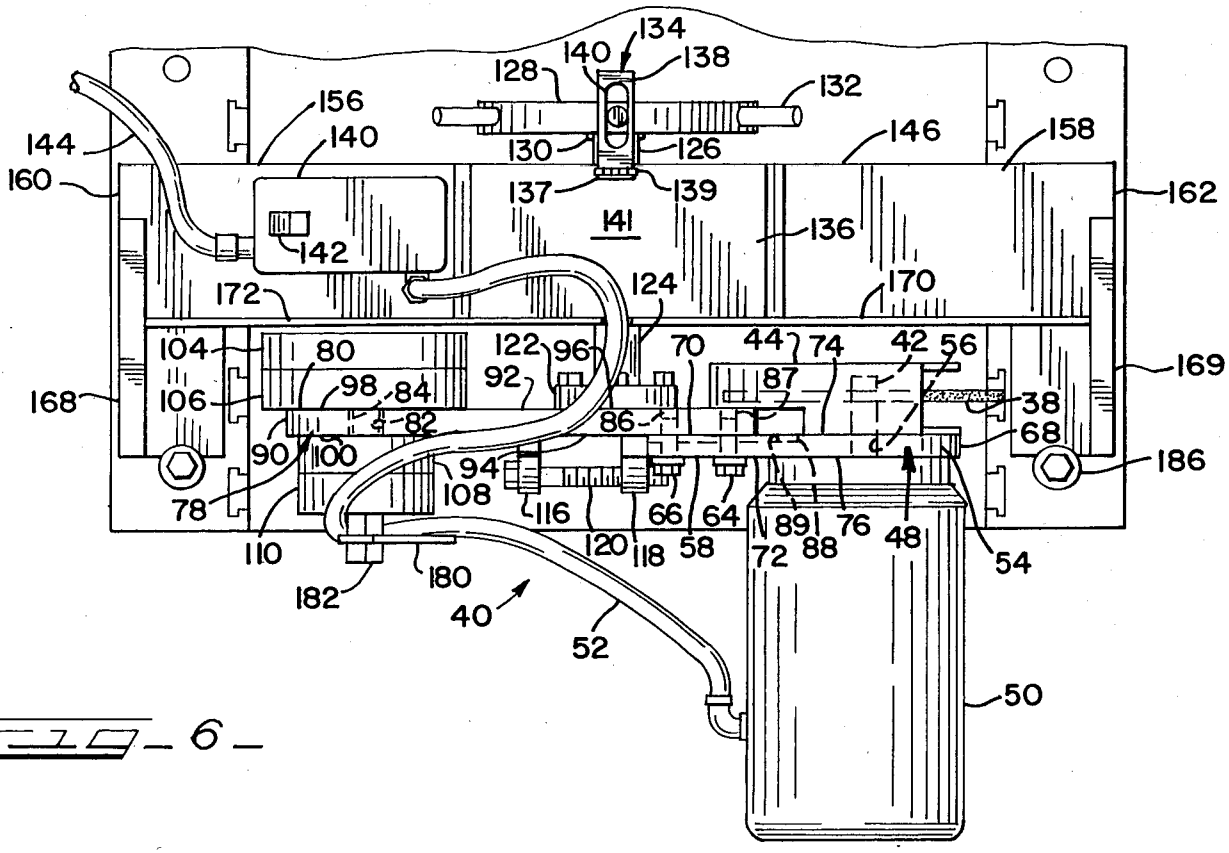
FIG. 9 is a perspective view of new stator blades being inserted into the grooved channels (tails) of the axial flow compressor case.

The knocked-out portions of the root sections and stator blades are emptied into a bin or other receptacle and new stator blades and new root sections are inserted into the grooved channels (recessed, dovetailed portions) of the compressor case as shown in FIG. 9.

The cutter assembly 40 of FIGS. 3–7 provides an effective and safe stator blade holder cutter for efficiently cutting the encased lower stub portions of the stator blades and base ring sections of a gas turbine. The cutter assembly has a power-driven, abrasive grinding wheel 38 mounted on a grinding wheel shaft 42 (FIG. 6). A substantial portion of the grinding wheel is covered, shielded, and protected by an arcuate grinding wheel cover 44. In the illustrative embodiment the grinding wheel cover extends and covers about 300 degrees of the grinding wheel. The grinding wheel cover can cover a greater or lesser amount of the wheel, if desired. The grinding wheel cover is substantially rigid and has a generally flat or planar upper arm-engaging, base portion 46 which faces and abuts against an upper control, swing arm 48. An electric motor 50 with an electric power cord 52 is mounted and positioned in coaxial alignment with the grinding wheel. The electric motor is operatively connected to and rotates the grinding wheel shaft to rotate and drive the grinding wheel. In one test unit, a fifteen horsepower electric motor was used and operated at 3600 rpm.

The upper control, swing arm or plate 48 is positioned between the motor and the grinding wheel cover. The upper arm has an upper, outer end portion 54 with an outer upper opening or hole 56 (FIG. 6) which rotatably receives the grinding wheel shaft. The upper, inner end portion 58 (FIG. 5) of the upper arm has an inward, upper pair of parallel elongated slots 60 and 62 which receive the bolts 64 of an adjustment fastening assembly 66. The upper outer end portion has a semicircular, convex, arcuate outer edge 68. The upper arm has parallel, upper, flat or planar, inwardly and outwardly facing surfaces 70 and 72 (FIG. 6) which extend between and connect the upper, inner, and outer end portions. The inwardly facing surface of the upper arm has a cover-engaging portion 74, which is positioned adjacent to the upper outer end portion and abuts against and engages the base portion of the grinding wheel cover. The upper outwardly facing surface of the upper arm has a motor-engaging portion 76, which is positioned adjacent to the upper end portion and abuts against and engages the electric motor.

A lower control, swing arm or plate 78 is securely connected to the upper arm by the bolts of the adjustment fastening assembly. The lower arm has a lower outer end portion 80 (FIG. 6) with an outer lower opening or hole 82 which is positioned diametrically opposite of the upper grinding wheel shaft-hole 56 of the upper arm. The lower opening receives the counterweight shaft 84. The lower, inner end portion of the lower arm has an inward, lower pair of tapped internally threaded holes or openings 86 and 87 which are aligned in registration with the slots of the upper arm. The bottom intermediate portion of the lower arm can have an outwardly extending key 88 which securely engages a keyway 89 in the upper arm to further securely connect and maintain the parallel relationship of the arms. The lower end portion of the lower arm has a semicircular, convex arcuate edge 90 positioned diametrically opposite of the curved upper end portion 68 of the upper arm. The lower arm has parallel, lower, flat or planar, inwardly and outwardly facing surfaces 92 and 94 which extend between and connect the lower, inner and outer end portions of the lower arm. The inwardly facing surface of the lower arm has a central, coupling-engaging portion 96 which is positioned in proximity to the lower outer end portion of the lower arm. The inwardly-facing surface of the lower arm also has an inner counterweight-engaging portion 98 which is positioned adjacent to the lower end portion of the lower arm. The outwardly-facing surface of the lower arm has an outer counterweight-engaging surface 100 which is positioned adjacent to the lower end portion of the lower arm and has a yoke-supporting surface 102 (FIG. 3).

The counterweight shaft extends through the lower opening of the lower arm. The counterweight shaft has an inner portion and an outer portion. A pair of inner circular counterweights 104 and 106 are securely mounted on the inner portion of the counterweight shaft. The inner counterweights abut against and engage the inner counterweight-engaging portion of the lower arm to substantially counterbalance the grinding wheel and cover to allow for smooth rotation and swing of the arms. A pair of outer circular counterweights 108 and 110 are securely mounted to the outer portion of the counterweight shaft. The outer counterweights are smaller than the inner counterweights. The outer counterweights abut against and engage the outer counterweight-engaging portion of the lower arm to substantially counterbalance the electric motor to help enhance the smooth rotation and swing of the swing arms.

Figure 3:
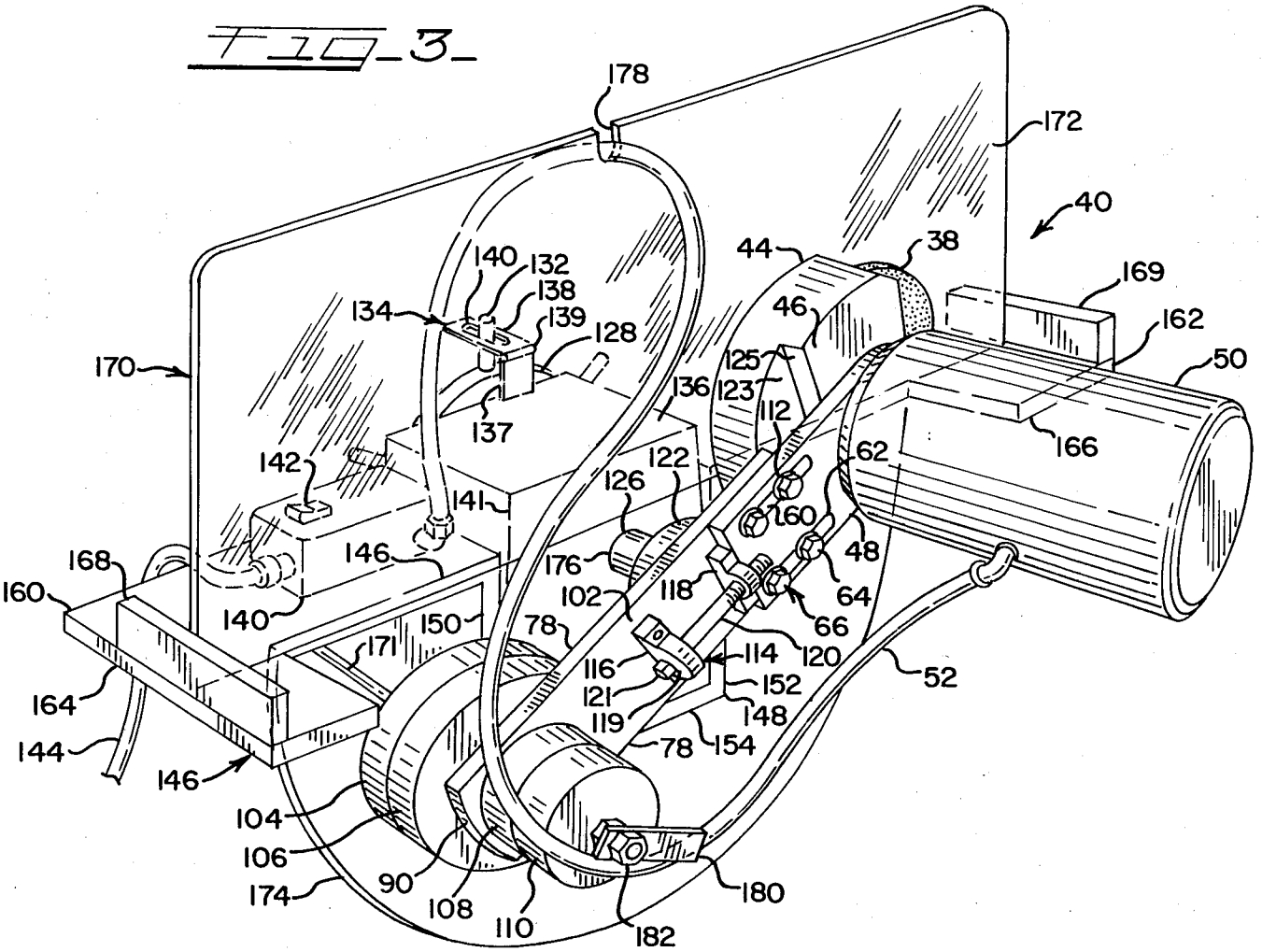
FIG. 3 is a perspective view of a cutter assembly in accordance with principles of the present invention.

As shown in FIG. 3, the adjustment fastening assembly 66 is connected to the swing arms to adjust the overall length and the diameter of rotation of the swing arms. The adjustment fastening assembly includes washers 112 and a set of bolts 64 or other fasteners which extend through the slots of the upper arms and are threadedly connected to tapped holes of the lower arms. The adjustment fastening assembly also includes the key 88 (FIGS. 5 and 6) and keyway 89 which help secure and maintain parallel alignment of the arms. The adjustment fastener assembly further includes a yoke or turnbuckle assembly 114 with a lower yoke 116 which is connected to the yoke-engaging surface of the lower arm, an upper, internally threaded, yoke 118 which is connected to the inner end portion of the upper arm, and a threaded rod or bolt 120. The lower yoke has an internal thrust bearing 119 which receives and engages the upper portion of the bolt (threaded) rod. The head 121 of the bolt abuts against the lower face of the lower yoke. The threaded end of the bolt threadedly engages the upper yoke to permit selective adjustment, expansion, and contraction of the overall span (length) and diameter of swing of the swing arms to control the depth of cut of the grinding wheel. The grinding wheel cover can have a recessed cutaway portion 123 with an abutment wall 125 to facilitate expansion and movement of the lower arm. While the illustrated arrangement is preferred, in some circumstances it may be desirable that the bolt or threaded rod also threadedly engage the lower yoke.

As shown in FIGS. 3 and 6, a coupling or bearing mount 122 is connected to the central coupling-engaging portion of the lower arm. A driven gear shaft 124 is securely connected to the coupling and positioned perpendicular to the inwardly facing surface of the lower arm.

A wheel-actuated drive shaft 126 (FIG. 6) is positioned in coaxial alignment with the gear shaft. A manually operable, steering wheel 128 has a hub 130 connected to the drive shaft to rotate the swing arms, grinding wheel, motor, and counterweights about the coupling and gear shaft. The steering wheel controls the angular speed and cutting of the grinding wheel. In the preferred embodiment the steering wheel is in the form of a spoked helmsman wheel with a set of manually grippable, outwardly extending, radial spokes or handles 132.

In order to lock the wheel in place, a locking arm 134 can be pivotally connected to a gear box 136. The locking arm has an upright locking arm portion 137 connected to and extending upwardly from the gear box and a pivotable, horizontal, locking arm portion 138 which is pivotally connected to the upright locking arm portions by a hinge or pivot pin 139. The horizontal locking arm has an elongated slot 140 which slides over and lockably receives the dead center, upwardly extending spoke or handle of the wheel.

The gear box houses a reduction gear assembly 141 with a set of intermeshing reduction gears. The gear box is positioned between and operatively connected to the wheel-actuated drive shaft and the gear-driven shaft (driven gear shaft) to substantially reduce the angular speed of rotation of the driven shaft and swing arms relative to the drive shaft and wheel. In one test unit, the gear box had a gear reduction ratio of 25:1.

A switch box and control panel 140 has a manually operable toggle switch 142 to remotely activate (turn on) and stop (shut off) the electric motor. The electric motor power cord 52 is connected to the outwardly facing side of the switch box. An outlet electric power cord 144 is connected to the outer end of the switch box.

A saddle assembly 146 provides a housing, support platform, and cradle to support the weight of the gear box and switch box. The saddle also provides a template and setup assembly to facilitate setup and cutting (grinding) of the base ring sections (root sections) and encased lower stub portions of the stator blades of the axial flow compressor case. The saddle assembly has a U-shaped support portion 148 which supports, receives and engages the gear box. The U-shaped support portion has parallel, upwardly extending legs 150 and 152 with upper and lower portions and a horizontal gear box and assembly-supporting strut member 154 which extends laterally between and connects the lower portions of the legs. Extending horizontally outwardly in opposite directions from the tops of the legs are horizontal, elongated, cantilevered support arms 156 and 158. The left arm provides a support platform to support and carry the switch box. The other arm can support other equipment. Each of the arms are about the same size and have a lateral guide member 160 or 162 at the unattached free end of the arm with flat or planar, downwardly facing portions 164 and 166 which provide guide plates that seat upon corresponding sections of the compressor case to facilitate setup and efficiency of cutting with the grinding wheel. Extending upwardly from each of the guide members is an outrigger, stiffener and stabilizer member 168 and 169 to enhance the stability of the saddle assembly and prevent rocking during use of the cutter assembly. The stiffener members can also serve as auxiliary guide members. One or more braces or gussets 171 can connect the legs and arms and brace their intersecting corners to rigidify and strengthen the saddle assembly. The gear box and switch box can be mounted to the saddle assembly by bolts or other suitable fasteners.

Figure 4:
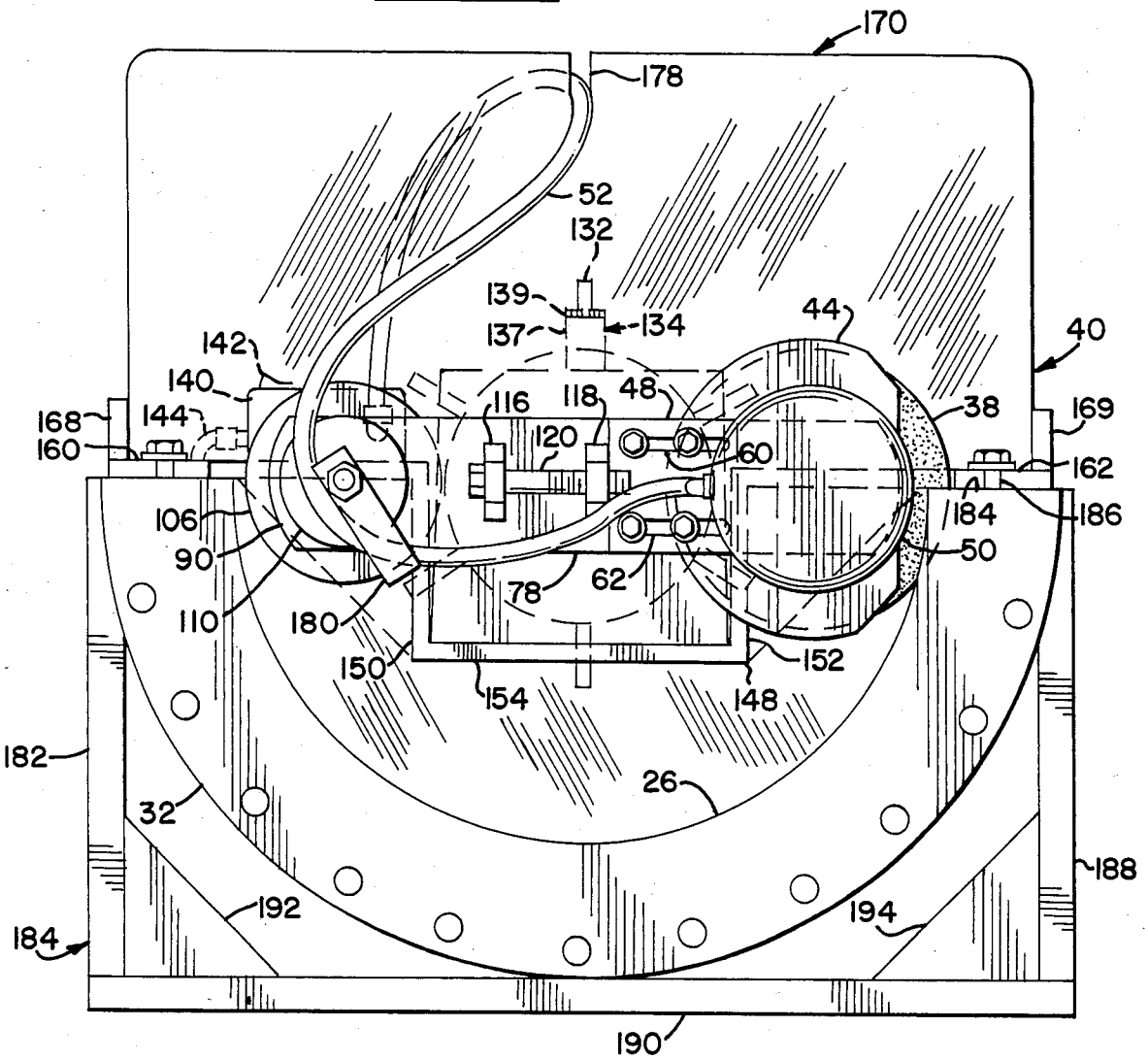
FIG. 4 is a front view of the cutter assembly.
Figure 5:
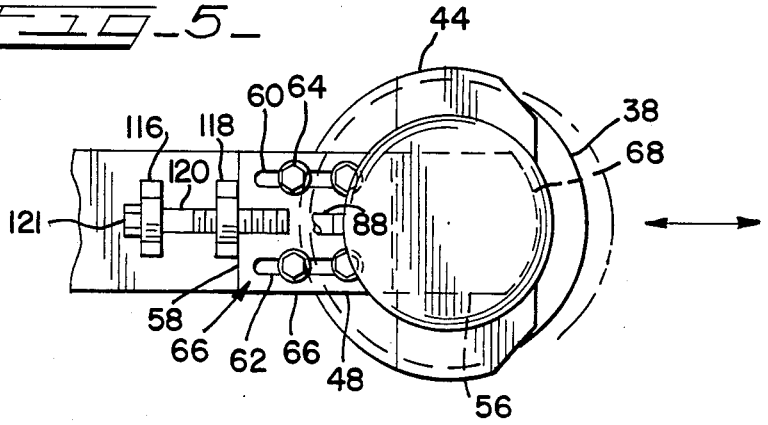
FIG. 5 is a front view of the grinding wheel and swing arms of the cutter assembly.

As shown in FIGS. 3, 4, and 7, an upright barrier wall 170 extends vertically between the: (1) saddle assembly, gear box, and wheel; and (2) the coupling, swing arms, grinding wheel, motor, and counterweights. The barrier wall has a generally rectangular, transparent upper portion 172 and a lower arcuate portion 174. The upper portion extends laterally between the outrigger stiffening members and upwardly from the ends (guide members) of the saddle assembly. The uppor portion of the barrier wall provides an upper, vertical, transparent safety shield 172 which permits viewing of the grinding wheel by an operator standing behind the steering wheel while protecting the operator's upper body, arms, face and eyes from sparks, metal chips and debris from the grinder and workpiece during grinding and cutting operations of the cutter assembly. The lower arcuate member of the barrier wall provides a semicircular, arcuate, convex guard plate 174 which is positioned against the outwardly facing sides of the arms and U-shaped portions of the saddle assembly and extends vertically downwardly from the safety shield. The semicircular guard plate protects the operator's legs and feet from sparks, flying metal chips and other debris from the grinder and workpiece during cutting and grinding operations of the cutter assembly. The lower semicircular guard plate has a circular, gear shaft-receiving opening or hole 176 (FIG. 3) in its upper middle portion, through which the gear shaft extends and rotates. The top central portion of the upper safety shield has a downwardly extending U-shaped notch, groove, or opening 178 to receive and support the electric motor power cord which connects the motor to the switch box.

A flat metal bar or finger 180 has an opening or hole at one end to slide upon the outer portion of the counterweight shaft. The finger is secured to the counterweight shaft by a nut 182. Desirably, the finger extends radially from the outer portion of the counterweight shaft to provide a power cord-guard member to abut against, engage, and hold the electric motor power cord which connects the motor to the switch box to prevent the power cord from contacting the rotating arms, grinding wheel, and gear shaft of the cutter assembly during cutting and/or rotation of the arms.

The axial flow compressor casing can be supported by an inverted U-shaped frame assembly 184 (FIGS. 1 and 4). The frame assembly has vertical support legs 186 and 188, a horizontal base 190, and corner braces or gussets 192 and 194.

In use, the axial flow compressor case of the gas turbine is partially disassembled and removed from the other portions of the gas turbine. Thereafter, the upper portions of the stator blades in the base ring sections of the axial flow compressor case are severed (cut off) with an arc air torch as shown in FIG. 2. The guide members of the saddle assembly are then placed and seated upon the flanges or flat sections 184 (FIGS. 4 and 7) of the axial flow compressor case. The guide members can be mounted or otherwise secured to the flanges or flat sections of the compressor case by bolts 186. The fasteners 64 and bolt 120 (threaded rod) of the adjustment fastener and yoke assembly can be adjusted to attain the desired radius of rotation of the swing arms and depth and cut of the grinding wheel. The power switch 142 in the switch box can be turned on to activate the motor and grinding wheel. The operator can then turn the wheel to rotate and arcuately move the swing arms so that the grinding wheel engages, grinds, and cuts the lower encased, dovetailed, stub portions of the stator blades and the base ring (root section) in two or more pieces as shown in FIG. 7. This procedure is continued for each of the base rings and lower encased stub portions of the stator blades, before the cutter assembly is removed.

The cut stub portions of the stator blades can then be heated to a temperature less than about 425° F. with an oxy-acetylene torch. The heated cut, lower stub portions of the stator blades are then jarred loose, vibrated, and knocked out of the base ring (root) sections by repetitively striking the cut stub portions of the stator blades and the base ring sections with a hammer H as shown in FIG. 8. Any loosened and knocked-out stub portions and base ring sections can be dumped or emptied into a bin or other receptacle. New stator blades 34 and base ring sections 26 are then inserted into the groove channels 30 of the axial flow compressor case 22 at uniform intervals as shown in FIG. 9. The axial flow compressor case can then be reassembled and mounted to the gas turbine for startup and use.

The cutter assembly and stator blade-removal and revamping process were extensively tested at the Amoco Oil Company Refinery at Texas City, Tex. It was unexpectedly and surprisingly found that the novel cutter assembly and revamping process were very effective in overhauling, revamping, repairing, and restoring the stator blades of a gas turbine and resulted in substantial savings of turnaround time of the gas turbine and downtime of the associated operating units. Previous conventional techniques and [prior art equipment required a team of at least four or five people working seven to ten 24-hour man-days to fix and restore the gas turbine blades. With the novel cutter assembly and revamping process described above, it took a team of only two or three people about one and one-half to two 24-hour days to fix and restore the gas turbine blades.

Among the many advantages of the preceding cutter assembly and stator blade-revamping and repair process are:

1. Substantially reduced downtime of the gas turbine and associated operating units.
2. Significantly less turnaround time.
3. Reduced labor and manpower requirements.
4. Decreasing the probability of cracking or otherwise damaging the compressor case by heating the cut stub portions of the stator blades to much lower temperatures than prior art techniques.
5. Enhanced efficiency.
6. Greater reliability.
7. Safer.
8. Economical.
9. More effective.

Although embodiments of this invention have been shown and described, it is to be understood that various modifications and substitutions, as well as rearrangements and combinations of parts, equipment, or process steps, can be made by those skilled in the art without departing from the novel spirit and scope of this invention.

What is claimed is:

1. A cutter assembly for cutting stator blades of a gas turbine, comprising:

a grinding wheel shaft;

an abrasive grinding wheel mounted on said shaft;

an arcuate grinding wheel cover for covering a substantial portion of said grinding wheel, said cover having a substantially planar, upper arm-engaging base portion;

an electrically powered motor positioned in coaxial alignment with said grinding wheel for rotating and driving said grinding wheel shaft, said motor having an electric power cord;

an upper swing arm positioned between said motor and said cover, said upper swing arm having an upper outer end portion defining an outer upper opening for rotatably receiving said grinding wheel shaft and an upper inner end portion defining an inward upper pair of substantially parallel, elongated slots, said upper outer end portion having an arcuate outer edge, said upper arm having an upper, substantially planar, inwardly facing surface extending between and connecting said upper end portions and an upper, substantially planar, outwardly facing surface extending between and connecting said upper end portions and positioned substantially parallel to said upper inwardly facing surface, said upper inwardly facing surface having a cover-engaging portion adjacent said upper outer end portion for abutting against and engaging said base portion of said cover and said upper outwardly facing surface having a motor-engaging portion adjacent said upper outer end portion for abutting against and engaging said motor;

a lower swing arm secured to said upper swing arm, said lower swing arm having a lower outer end portion defining an outer lower opening positioned diametrically opposite said upper opening and a lower inner end portion defining a pair of bolt-receiving threaded holes aligned in registration with said slots of said upper arm, said lower end portion having an arcuate edge, said lower arm having a lower, substantially planar, inwardly facing surface extending between and connecting said lower end portions and a lower, substantially planar, outwardly facing surface extending between and connecting said lower end portions and positioned substantially parallel to said lower inwardly facing surface, said lower inwardly facing surface having a central coupling-engaging portion positioned in proximity to said lower outer end portion and having an inner counterweight-engaging portion positioned adjacent said lower end portion, and said lower outwardly facing surface having an outer counterweight-engaging surface positioned adjacent said lower end portion;

a counterweight shaft extending through said outer lower opening of said lower swing arm, said counterweight shaft having an inner portion and an outer portion;

at least one inner counterweight secured on said inner portion of said counterweight shaft and abutting against and engaging said inner counterweight-engaging portion of said lower arm for substantially counter-balancing said grinding wheel and cover;

at least one outer counterweight secured on said outer portion counterweight shaft and abutting against and engaging said outer counterweight-engaging portion of said lower arm for substantially counterbalancing said motor;

an adjustment assembly connected to said arm for adjusting the overall length and diameter of rotation of said arms, said adjustment means including a set of fasteners extending through said slots of said upper arm and threadedly engaging said threaded holes of said lower arm;

a coupling connected to said central coupling-engaging portion of said lower arm;

a driven gear shaft connected to said coupling and positioned substantially perpendicular to said inwardly facing surface of said lower arm;

a wheel-actuated drive shaft positioned in coaxial alignment with said gear shaft;

a reduction gear assembly comprising a set of intermeshing reduction gears positioned between and operatively connected to said drive shaft and said driven shaft for substantially reducing the angular speed of rotation of said driven shaft relative to said drive shaft;

a manually operable steering wheel having a hub connected to said drive shaft for rotating said arms, grinding wheel, motor and counterweights about said coupling and gear shaft, to selectively engage the grinding wheel in cutting engagement with the stator blades of a gas turbine;

a control panel operatively connected to said electric power cord and having a manually operable switch for selectively activating said motor;

a saddle assembly having a generally U-shaped portion for supporting said reduction gear assembly, said U-shaped portion having substantially parallel, upwardly extending legs with upper and lower portions and a substantially horizontal gear assembly-supporting member extending between and connecting said lower portions of said legs, said saddle assembly having substantially horizontal, elongated, cantilevered support arms extending laterally outwardly in opposite directions from said upper portions of said legs for supporting said control panel, and said support platforms having lateral guide members with substantially planar, downwardly facing portions providing guide plates for seating upon sections of the compressor case of said gas turbine to facilitate setup and efficiency of cutting with said grinding wheel;

an upright barrier wall positioned between said saddle assembly and said rotatable arms carrying said grinding wheel, said upright barrier wall defining a gear shaft-receiving opening and having an upper transparent safety shield for permitting viewing of the grinding wheel while protecting the operator's upper body, arms, face, and eyes and an arcuate guard plate extending substantially downwardly from said safety shield for protecting the operator's legs from flying metal chips and other debris during operation of said cutter assembly.

2. A cutter assembly in accordance with claim 1 including a finger comprising a guard member connected to and extending radially from said outer counterweight for abuttingly engaging and holding said power cord and substantially preventing said power cord from contacting said grinding wheel and wherein said safety shield defines an opening for receiving said power cord.

3. A cutter assembly in accordance with claim 1 wherein said adjustment assembly includes a lower yoke connected to said lower swing arm, an upper internally threaded yoke connected to said upper swing arm, and a threaded rod secured to said lower yoke and threadedly engaging said upper yoke for selectively adjusting the overall span of said arms.

4. A cutter assembly in accordance with claim 1 wherein said wheel comprises a helmsman wheel with manually grippable, outwardly extending spokes comprising radial handles.

5. A cutter assembly in accordance with claim 4 including a locking arm pivotally connected to said gear assembly for locking said wheel, said locking arm defining an elongated slot for receiving one of said spokes.

* * * * *